US008876581B2

(12) United States Patent
Ulmanen et al.

(10) Patent No.: US 8,876,581 B2
(45) Date of Patent: Nov. 4, 2014

(54) SUPPLY AIR TERMINAL DEVICE

(75) Inventors: Heimo Ulmanen, Kausala (FI); Reijo Villikka, Kausala (FI)

(73) Assignee: Halton Oy, Kausala (FI)

( * ) Notice: Subject to any disclaimer, the term of this patent is extended or adjusted under 35 U.S.C. 154(b) by 1214 days.

(21) Appl. No.: 12/032,216

(22) Filed: Feb. 15, 2008

(65) Prior Publication Data

US 2008/0200112 A1 Aug. 21, 2008

(30) Foreign Application Priority Data

Feb. 16, 2007 (FI) ..... 20075112

(51) Int. Cl.

| | |
|---|---|
| ***F24F 7/00*** | (2006.01) |
| ***F24F 1/01*** | (2011.01) |
| ***F24H 3/04*** | (2006.01) |
| *F24F 1/00* | (2011.01) |

(52) U.S. Cl.

CPC ..... *F24F 1/0007* (2013.01); *F24F 1/01* (2013.01); *F24F 2221/34* (2013.01); *F24F 2001/0062* (2013.01); *F24H 3/0411* (2013.01); *F24F 2001/0037* (2013.01); *F24F 2001/0051* (2013.01)

USPC ..... 454/261

(58) Field of Classification Search

USPC ..... 454/261, 263, 269, 264, 233, 228, 230, 454/231, 232, 236, 305; 165/59

See application file for complete search history.

(56) References Cited

U.S. PATENT DOCUMENTS

| | | | | |
|---|---|---|---|---|
| 5,127,878 | A * | 7/1992 | Meckler | 454/264 |
| 5,407,741 | A * | 4/1995 | Ota | 428/323 |
| 5,616,266 | A * | 4/1997 | Cooper | 219/407 |
| 5,884,500 | A * | 3/1999 | Wetzel | 62/259.1 |
| 6,213,867 | B1 * | 4/2001 | Yazici et al. | 454/263 |
| 6,769,477 | B2 * | 8/2004 | Hakkinen et al. | 165/123 |
| 7,185,510 | B2 * | 3/2007 | Lee et al. | 62/419 |
| 2002/0062948 | A1 | 5/2002 | Horttanainen et al. | |
| 2004/0251244 | A1 * | 12/2004 | Torigoe | 219/208 |
| 2006/0211365 | A1 * | 9/2006 | Petrovic | 454/261 |
| 2008/0223841 | A1 * | 9/2008 | Lofy | 219/202 |

FOREIGN PATENT DOCUMENTS

| | | | |
|---|---|---|---|
| DE | 3042077 | A1 | 5/1981 |
| DE | 3419001 | A1 | 11/1985 |
| GB | 2413378 | A | 10/2005 |
| JP | 1-159989 | | 6/1989 |
| JP | 2006062609 | A * | 3/2006 |

OTHER PUBLICATIONS

Search Report issued in application No. FI 20075112.

* cited by examiner

*Primary Examiner* — Steven B McAllister
*Assistant Examiner* — Brittany Towns
(74) *Attorney, Agent, or Firm* — Stiennon & Stiennon

(57) ABSTRACT

A supply air terminal device (10) has a supply air chamber (12), into which fresh air is conducted from out of doors and further from it through a nozzle gap or nozzles (12$a_1$, 12$a_2$ . . . ) into a mixing chamber (14). The fresh supply air ($L_1$) induces a circulated airflow ($L_2$) from a room (H) to flow through a heat exchanger (13) into the mixing chamber (14). The combined airflow ($L_1$+$L_2$) combined in the device solution of the fresh supply air ($L_1$) and the room air ($L_2$) flow is made to flow from the mixing chamber (14) into a room space (H) or other such. The mixing chamber (14) of the supply air terminal device (10) has in the mixing chamber (14) or in connection with this in a flow passage (14') a film element (15), preferably a film-like electric resistance.

10 Claims, 4 Drawing Sheets

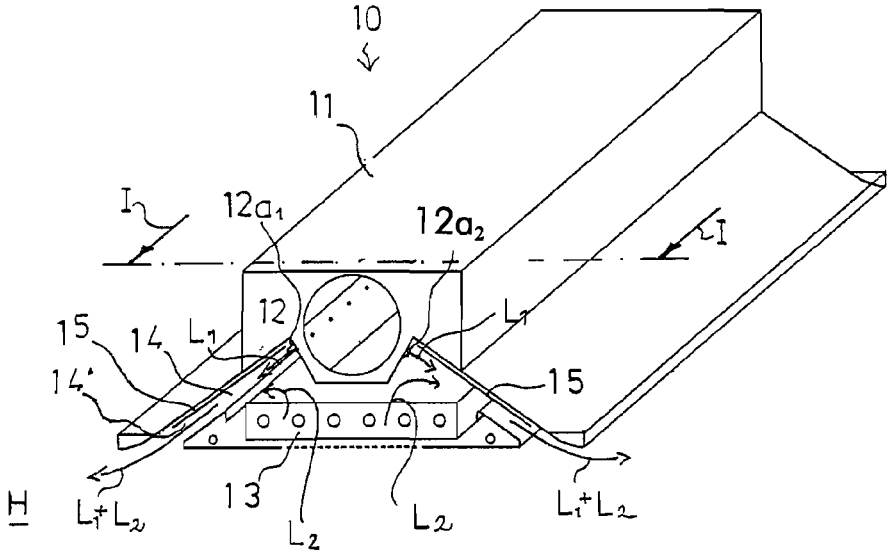
FIG 1A
FIG 2A
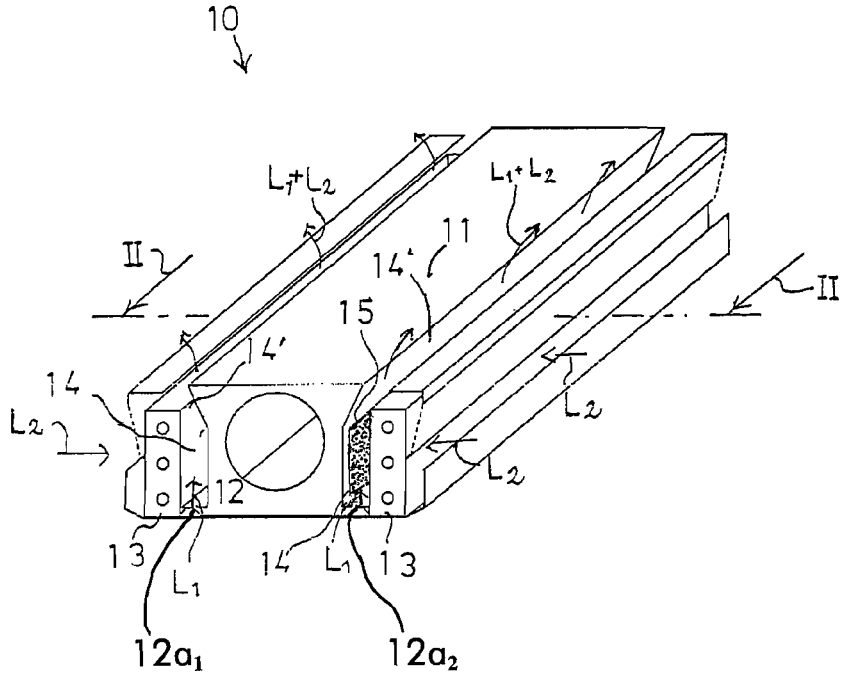

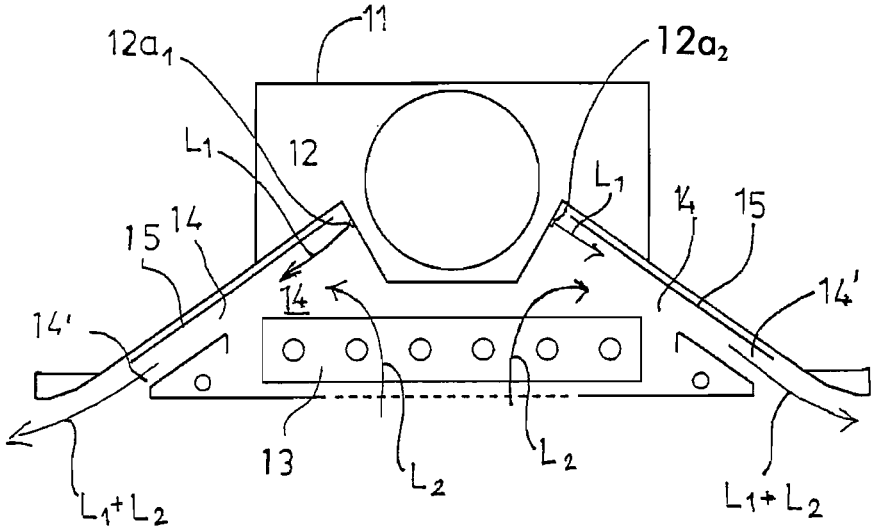
FIG 1B
FIG 2B
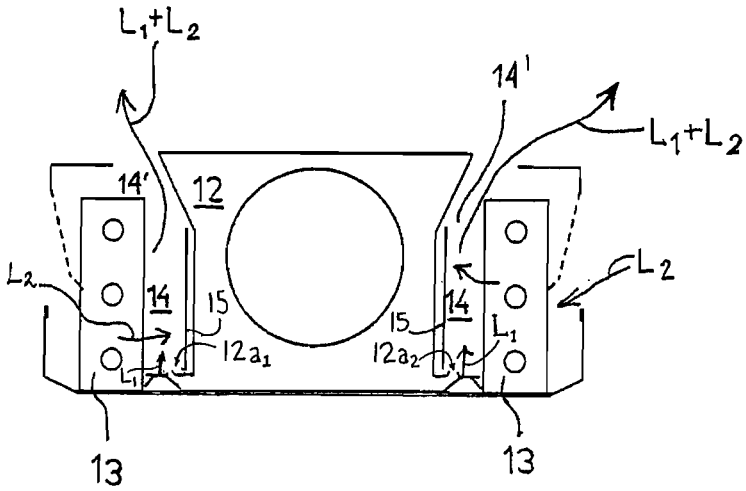

SUPPLY AIR TERMINAL DEVICE

CROSS REFERENCES TO RELATED APPLICATIONS

This application claims priority on Finnish App. No. 20075112, filed Feb. 16, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a supply air terminal device.

The state of the art knows so-called heating and cooling manifolds, through which room air is circulated and through which fresh outdoor air is also brought mixed with the room air into the room space. With the above-mentioned devices the room air can be cooled in summer and heated in winter. In the heating case, a heat exchanger can be equipped with a two-sided circuit for circulating a heat carrier, wherein in one circuit a heat carrier is transported for cooling and wherein in the other circuit a heat carrier is transported for heating. Such an embodiment is also possible, that one and the same tube system is used for both purposes. In certain cases there is only a cooling tube system and the heating is carried out by separate heat resistances, which are placed in connection with a heat exchanger and in spaces between heat-exchanging tubes.

The primary air can be heated by a separate duct heater. When the primary airflow rate is relatively low, this leads to rather high supply air temperatures, and the heater must also be equipped with an overheating protector as safety equipment.

There are air-conditioning manifolds on the market, where electric heating is implemented by installing an electric resistance inside the heat exchanger. In order to achieve sufficient efficiency, the resistance must be designed so that the surface temperature of the resistance will rise easily to hundreds of degrees, whereby the device must be provided with overheating protections.

Such air-conditioning manifolds are also on the market, where a heating film is glued directly on to the device's outer or inner surface, whereby elimination of thermal expansion has been a challenging task.

SUMMARY OF THE INVENTION

In the air-conditioning manifold according to the invention, the heating element used is a film element, that is, a so-called heating film, which in order to achieve sufficient power is dimensioned so that the surface temperatures of the device will be under 80° C. at all times. No separate overheating protections are hereby needed. According to the invention, the film element is attached in connection with the mixing chamber of the supply air terminal device.

The film element is glued on to a separate plate, the material of which can preferably be a plastic or ceramic material. With its plates, the heating film constitutes a film element. The film element may contain heat-insulating material. The film element may contain material, which restricts thermal radiation. The film element may contain material, which restricts capacitive leakage current.

The film element is located in a mixing chamber in such a way that a combined airflow $L_1+L_2$ will "flush" the heating element, and in this way the best possible heat transfer is obtained from the film element to the combined airflow.

The film element in question can be integrated both with freely installed air-conditioning manifolds and with integrated ones, which are installed in false ceilings.

The heating element can be installed attached to a wall in the mixing chamber (a so-called free-installation manifold, FIG. 2A), whereby heat can also be transferred through the wall of the mixing chamber into the fresh primary air, or in such a way that in between the heating element and the mixing chamber there is a 1 . . . 15 mm air gap (a manifold integrated in a so-called false ceiling, FIG. 1A), whereby heat is transferred as little as possible into the space between the false ceiling.

In this application it was realized to use a film element and in such a manner that said film element is fitted into the mixing chamber of the supply air terminal device or in connection with it. According to the invention, the film element is fitted in such a way into the mixing chamber that plane T1 of the film element will be located in the direction of flow of the airflow, whereby the combined airflow $L_1+L_2$ of the circulated airflow of the room and the fresh supply airflow will wash over the surfaces of the film element. In this way, heating of the air takes place with the aid of convection. Said convection heating is considerably more efficient than, for example, radiation at the concerned heating element.

According to the invention, the film element is fitted into the mixing chamber or directly in connection with it and in contact with the airflow $L_1+L_2$ to be heated. The film element is fitted into an installation body, which preferably is of heat-insulating material and attached to a wall of the mixing chamber. The film element may also be attached through separate intermediate parts to a wall of the mixing chamber. In this way heat is prevented from transferring from the film element to wall structures, but it will transfer only by convection directly into the combined airflow $L_1+L_2$. Another advantage obtained by placing the film element directly in connection with the airflow $L_1+L_2$ is that all the heat as it transfers into the airflow $L_1+L_2$ is used efficiently and it will not end up in the wall structures, where it would cause deformations and loss of energy.

The invention is presented in the following by referring to some advantageous embodiments of the invention shown in figures of the appended drawings, but there is no intention to restrict the invention to these embodiments alone.

BRIEF DESCRIPTION OF THE DRAWINGS

FIG. 1A is an axonometric view of the supply air terminal device according to the invention.

FIG. 1B is a cross-sectional view along line I-I of FIG. 1A.

FIG. 2A shows another advantageous embodiment of the supply air terminal device according to the invention.

FIG. 2B is a cross-sectional view along line II-II of FIG. 2A.

DESCRIPTION OF THE PREFERRED EMBODIMENTS

Figure 3:
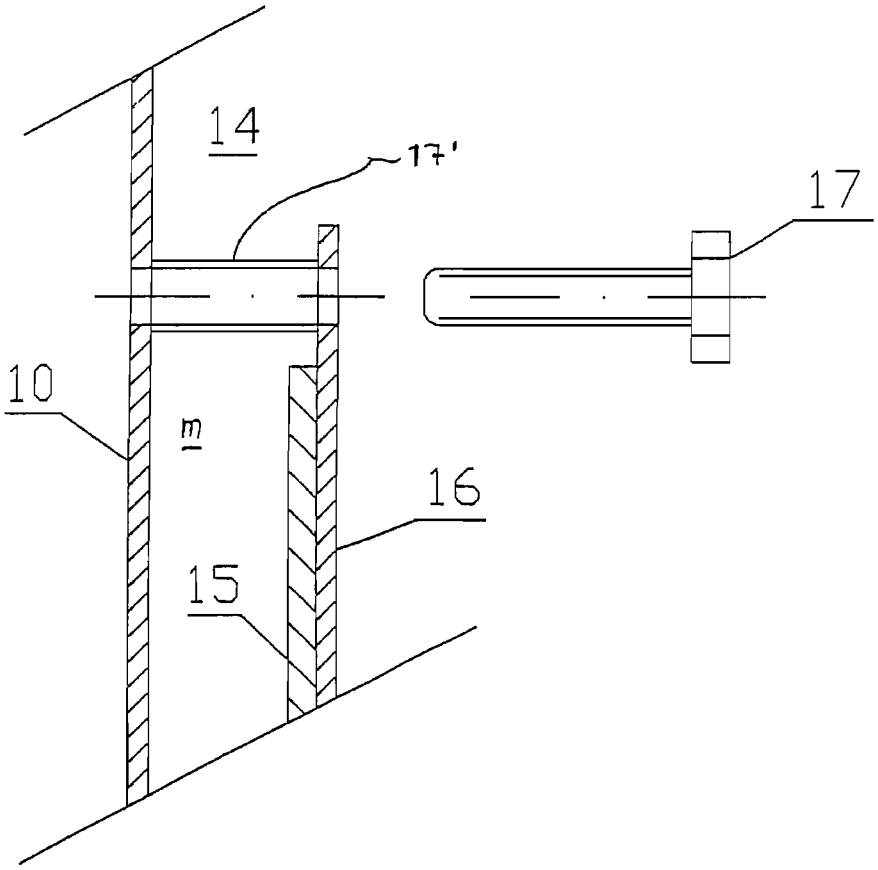
FIG. 3 shows how a film element is fitted in a removable manner into the supply air terminal device.

FIG. 1A shows the supply air terminal device 10 according to the invention and FIG. 1B is a cross-sectional view along line I-I of FIG. 1A.

As shown in FIGS. 1A and 1B, the supply air terminal device 10 comprises a body 11, a supply air chamber 12, a heat exchanger 13 and mixing chambers 14. Fresh air is supplied from out of doors with the aid of a blowing fan not shown into the supply air chamber 12 and from this through nozzles $12a_1$, $12a_2$ (arrow $L_1$) into a mixing chamber 14 and into a passage 14'. The fresh supply air conducted into the mixing chamber induces a circulated airflow $L_2$ from room space H by flowing through heat exchanger 13 to join the supply air flow $L_1$. The flows $L_1$ and $L_2$ are combined in the mixing chamber 14 and the combined airflow $L_1+L_2$ is conducted from mixing chamber 14 into room space H, preferably guided in the direction of the false ceiling.

According to the invention, the mixing chamber 14 and its outlet passage 14' comprise in connection with them a planar heat transferring element, that is, a film element 15, preferably a film-like thermal resistance, which is electric and the surface of which will become hot and will heat the airflow $L_1+L_2$ in the mixing chamber.

The planar film element 15 is preferably electric. The element's 15 electric power and heating power are preferably within a range of 100-600 W/m. It is advantageous to heat the combined airflow $L_1+L_2$. In the combined airflow there is typically, for example, a certain share 4 of the $L_2$ flow and a certain share 1 of the $L_1$ supply air flow. In this manner heat is transferred efficiently into the total airflow rate $L_1+L_2$, that is, into rate unit 5, and the heat transfer is made more efficient into the air $L_1+L_2$, arriving into room H. A preferable location for the film element 15, such as a thermal resistance film, in the mixing chamber 14 is on a surface of installation body 16, which surface is of heat-insulating material and is further attached to an inside surface of mixing chamber 14. The film element 15 is preferably attached in a removable manner to said body piece 16 by attaching means 17. It is hereby an advantage that the heat transferring element 15 can be installed afterwards in the supply air terminal device 10, whereby the supply air terminal device is formed as a modular structure, which from the standard product form can be complemented, for example, by adding an electric film element.

FIG. 2A shows an embodiment of the invention, wherein the combined airflow $L_1+L_2$ is blown upwards in the device. FIG. 2B is a cross-sectional view along line II-II of FIG. 2A.

In the embodiment shown in FIGS. 2A, 2B, fresh supply air is brought (arrows $L_1$) into supply air chamber 12 and it is conducted through nozzles $12a_1$, $12a_2$ . . . into mixing chamber 14. The circulated airflow $L_2$ of the room is conducted from room H from the side into mixing chamber 14 and through heat exchanger 13. The combined airflow $L_1+L_2$ is made to flow upwards from the device. The fresh supply air flow $L_1$ induces a circulated airflow $L_2$ to flow through heat exchanger 13. With the aid of heat exchanger 13 it is possible either to cool or heat the circulated airflow $L_2$. In the case of an electric resistance embodiment with a heat exchanger 13, the circulated airflow $L_2$ is cooled, and with the film element 15 according to the invention the combined airflow $L_1+L_2$ of circulated airflow $L_2$ and fresh supply airflow $L_1$ is heated. Also in the embodiment shown in the figure the mixing chamber 14 and the passage 14' after it are equipped with a film element 15 according to the invention. Also in the embodiment shown in FIGS. 2A, 2B the element 15 is connected in a removable manner to a base, that is, to an installation body 16 with attaching means 17 to the supply air terminal device 10. The base 16 is preferably of a heat-insulating material and thus it efficiently prevents heat from ending up in body structures 11 from the film element 15 proper. The film element 15 is fitted into the supply air terminal device along the length of its mixing chamber.

FIG. 3 shows in an illustrating manner how the heating element or film element 15 according to the invention is attached in a removable manner to the structures by attaching means 17. The removable feature according to the invention makes it possible that also such supply air terminal devices 10, which did not originally comprise a film element 15, can now later be equipped with an electric film resistance of the kind mentioned. The modular character of the device is thus increased. In the figure, the attaching means 17 are screws, which are placed through spacing pieces 17', such as bushings, to be attached to the device 10 in order to attach the film element 15 and the base 16 to the supply air terminal device 10. An air gap m remains between element 15 and device 10 for the airflow $L_1+L_2$. The gap is preferably in a range of 1-15 mm.

Figure 4:
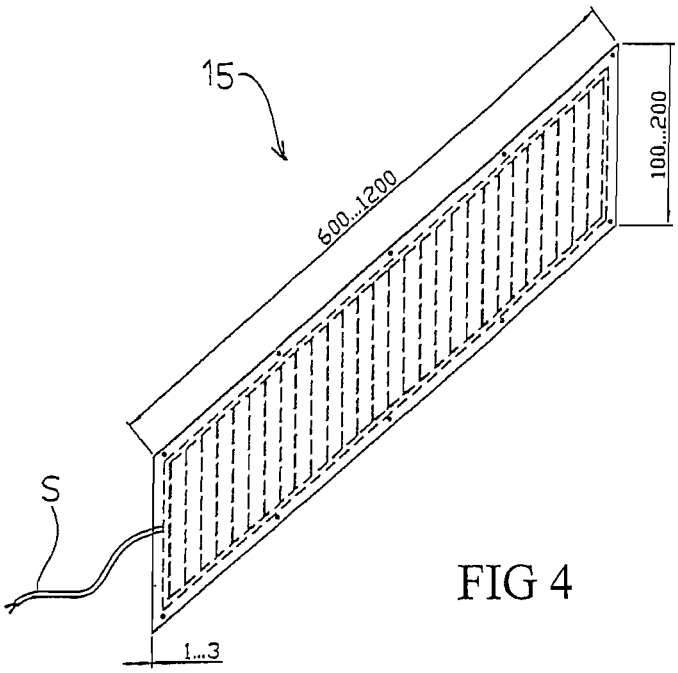
FIG. 4 shows a typical film element.

FIG. 4 shows a typical plate-like, flexible and thin film element with its typical measurements of 600-1200 mm long by 100-200 mm wide by 1-3 mm thick. An electric cable is indicated by the letter S. The electric resistance extends in a zigzag manner between the surfaces of the film element 15. The film element is glued on to separate sheets; to base 16. The base or installation body 16 may contain a material restricting capacitive leakage current, besides the heat-insulating material.

The film element 15 is preferably an electric resistance. It may be formed, for example, by a resistance wire placed in between the flexible surface parts in a zigzag manner.

We claim:

1. A supply air terminal device comprising:

a supply air chamber extending in a first longitudinal direction along which air within the supply air chamber flows, the supply air chamber having a fresh supply air inlet arranged to receive a supply of air from out of doors;

a mixing chamber adjoining the supply air chamber;

portions of the supply air terminal device forming a flow passage in air receiving relation with the mixing chamber, and in air supplying relation to a room;

a nozzle gap or a plurality of nozzles extending from the supply air chamber into the mixing chamber;

wherein the mixing chamber and the flow passage are arranged to extend in a second direction towards the room;

a heat exchanger forming part of the supply air terminal device, and arranged to pass air from the room containing the supply air terminal device into the mixing chamber;

wherein the nozzle gap or the plurality of nozzles is arranged so that air flowing through the nozzle gap or the plurality of nozzles from the supply air chamber in to the mixing chamber draws air from a room containing the supply air terminal device through the heat exchanger in to the mixing chamber, so that air passing through the heat exchanger and air from the fresh supply air inlet are mixed and discharged through the flow passage along the second direction;

a planar film electric resistance heating element lying in a plane and which is mounted in the mixing chamber or the flow passage in the first longitudinal direction, such that the planar film electrical resistance heating element extends in the first longitudinal direction;

wherein the electric resistance heating element is connected to a source of electrical power, and the electric resistance heating element is selected such that it will dissipate 100 to 600 W per meter in the longitudinal direction when connected to the source of electrical power, and the electric resistance heating element is arranged such that the electric resistance heating element remains under 80° Celsius; and wherein the electric resistance heating element is structured and mounted in the mixing chamber or the flow passage of the supply air terminal device in such a way that the air will wash over the electric resistance heating element.

2. The device of claim 1 wherein the heating element defines a plane and is mounted spaced from a wall of the mixing chamber or a wall of the flow passage so that air passing through the heat exchanger and from air from the fresh air inlet, discharges along the plane of the heating element.

3. The device of claim 2 wherein the heating element is removably attached by fasteners to the wall of the mixing chamber or the wall of the flow passage.

4. The device of claim 2 wherein the heating element is connected to an installation body of a heat-insulating material which is attached to the wall of the mixing chamber or the wall of the flow passage.

5. The device of claim 2 wherein the heating element mounted spaced from the wall of the mixing chamber or the wall of the flow passage is arranged so that air mixed from air passing through the heat exchanger and the air from the fresh air inlet is arranged to travel on both sides of the heating element.

6. The device of claim 1 wherein the heating element is removably connected by fasteners to the supply air terminal device inside the mixing chamber.

7. The device of claim 1 wherein an air gap is arranged in between the film element and a wall of the mixing chamber or a wall of the flow passage.

8. The device of claim 4 wherein the film element is attached with glue to the installation body.

9. The device of claim 1 wherein the heating element defines a plane and is removably attached by fasteners spaced from a wall of the mixing chamber or a wall of the flow passage so that air passing through the heat exchanger and air from the fresh air inlet discharges along the plane of the electric resistance heating element on both sides of the heating element.

10. A method of supplying conditioned air to a room in a supply air chamber extending in a first longitudinal direction along which air within the supply air chamber flows, the supply air chamber having a fresh supply air inlet arranged to receive a supply of air from out of doors; a mixing chamber adjoining the supply air chamber; portions of the supply air terminal device forming a flow passage in air receiving relation with the mixing chamber, and in air supplying relation to a room; a nozzle gap or a plurality of nozzles extending from the supply air chamber into the mixing chamber; wherein the mixing chamber and the flow passage are arranged to extend in a second direction towards the room; a heat exchanger forming part of the supply air terminal device, and arranged to pass air from the room containing the supply air terminal device into the mixing chamber; wherein the nozzle gap or the plurality of nozzles is arranged so that air flowing through the nozzle gap or the plurality of nozzles from the supply air chamber in to the mixing chamber draws air from a room containing the supply air terminal device through the heat exchanger in to the mixing chamber, so that air passing through the heat exchanger and air from the fresh supply air inlet are mixed and discharged through the flow passage along the second direction; a planar film electric resistance heating element lying in a plane and which is mounted in the mixing chamber or the flow passage in the first longitudinal direction, such that the planar film electrical resistance heating element extends in the first longitudinal direction; the method comprising the steps of:

drawing fresh air into the supply air chamber extending in a first longitudinal direction and flowing said fresh air along the first longitudinal direction of the supply air chamber;

blowing the fresh air from the supply air chamber through the nozzle gap or plurality of nozzles into the mixing chamber which extends in the first longitudinal direction and adjoins the supply air chamber;

drawing room air from a room through a heat exchanger into the mixing chamber, mixing the room air and the fresh air and discharging the mixed fresh air and room air back into the room through a flow passage which extends in the first longitudinal direction;

heating mixed fresh air and room air with the planar film electric resistance heating element lying in the plane and which is mounted in the mixing chamber or the flow passage;

supplying the electric resistance heating element with electrical power at the rate of 100 to 600 W per meter in the first longitudinal direction such that the electric resistance heating element remains under 80° Celsius;

structuring and mounting the electric resistance heating element in the mixing chamber or the flow passage of the supply air terminal device in such a way that the air will wash over the electric resistance heating element.

* * * * *